United States Patent [19]

Walker et al.

[11] 4,264,969

[45] Apr. 28, 1981

[54] STANDARDIZED ELECTRONIC WATCH MOVEMENT

[75] Inventors: Erich Walker, Orvin; Werner R. Baumgartner, Orpund, both of Switzerland

[73] Assignee: Bulova Watch Company, Inc., Flushing, N.Y.

[21] Appl. No.: 52,842

[22] Filed: Jun. 28, 1979

[51] Int. Cl.[3] ..... G04B 29/00

[52] U.S. Cl. ..... 368/319; 368/320; 368/318; 368/88; 368/62; 368/76; 368/204

[58] Field of Search ..... 58/23 R, 23 D, 23 BA, 58/85.5, 50 R, 88 R; 368/204, 76, 62, 88, 318, 319, 320

[56] References Cited

U.S. PATENT DOCUMENTS

| | | | |
|---|---|---|---|
| 3,555,811 | 1/1971 | Von Zeppelin et al. | 58/23 BA |
| 3,736,741 | 6/1973 | Paratte | 58/23 BA |
| 3,966,498 | 6/1976 | Wuthrich | 58/23 BA X |
| 3,967,442 | 7/1976 | Berney | 58/85.5 X |
| 4,103,482 | 8/1978 | Maruyama | 58/23 BA X |
| 4,117,663 | 10/1978 | Mosimann et al. | 58/85.5 |

*Primary Examiner*—Ulysses Weldon
*Attorney, Agent, or Firm*—Michael Ebert

[57] ABSTRACT

In order to simplify the production of electronic watches, there is provided a family of standardized movements whose members can be housed within a variety of watch cases of different size and shape. All movements in the family are identical but for their mounting plates which differ in size, and in some instances also in shape, to render the movements receivable in differently-configured cases. The standardized movements in the family include batteries of different size which take advantage of the space made available by the plates of different size to afford optimum battery life.

2 Claims, 4 Drawing Figures

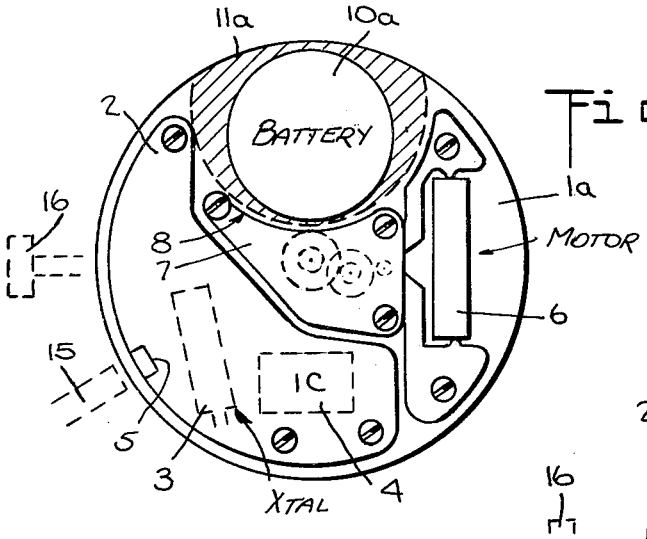
Fig. 1.
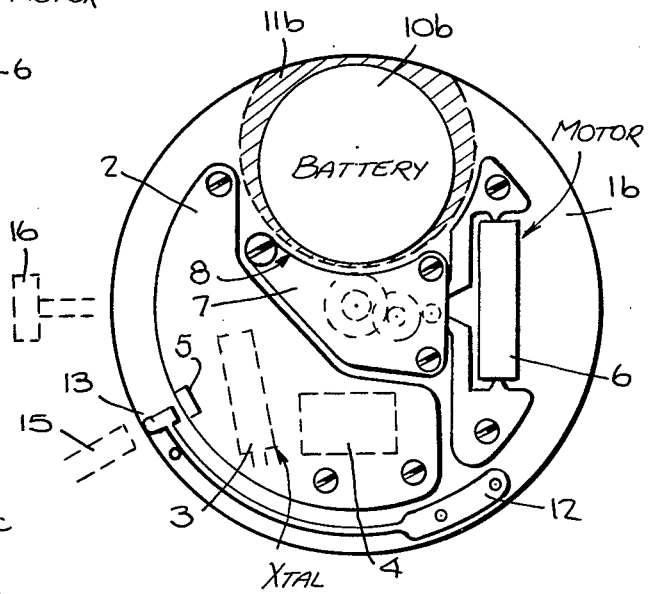
Fig. 2.
Fig. 3.
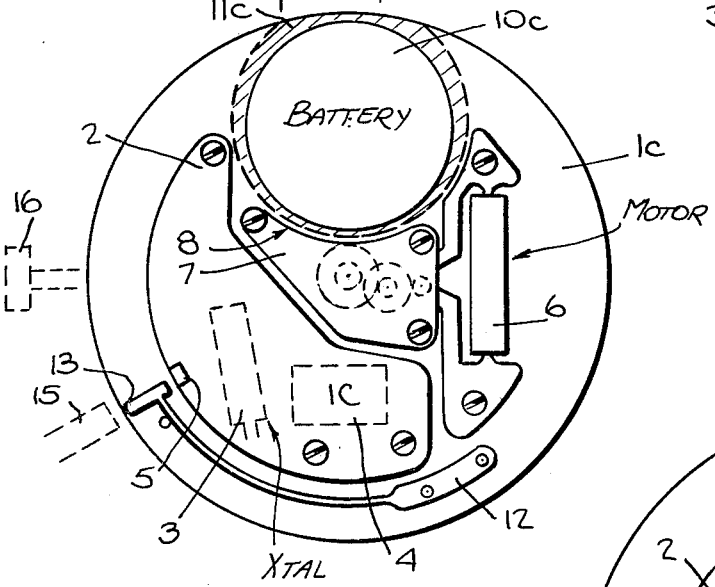
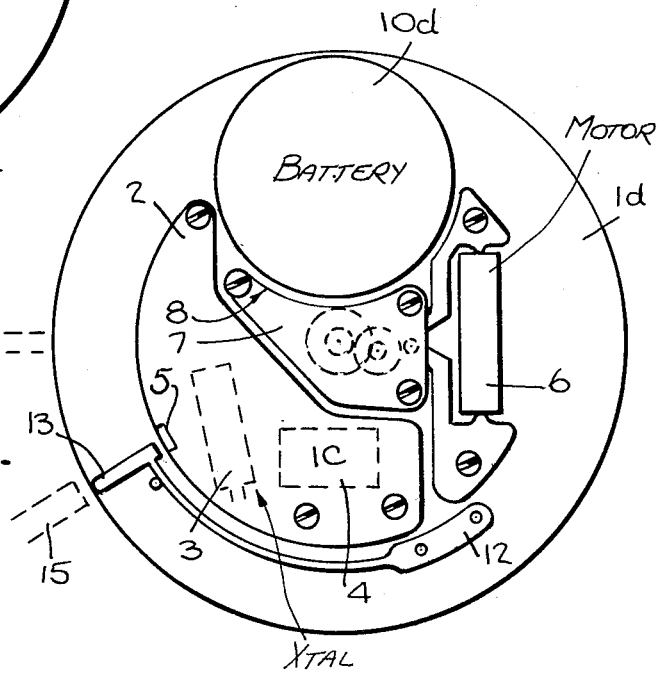
Fig. 4.

STANDARDIZED ELECTRONIC WATCH MOVEMENT

BACKGROUND OF INVENTION

1. Field of Invention

The present invention relates generally to movements for battery-operated electronic watches which are receivable in cases, and more particularly to a family of such movements, all of which are identical save for the plates on which the electronic and mechanical components are mounted whereby the movements in the family may be used in conjunction with a variety of watch cases.

2. Prior Art

Manufacturers of electronic watches are being compelled by prevailing market conditions to streamline their production procedures in order to reduce manufacturing costs. The need, therefore exists for standardized electronic watch movements which may be mass-produced and are suitable for incorporation in watch cases of the most varied type.

For this purpose, it is already known to provide a watch movement of standardized design, the movement being accommodated to fit within a particular form of case by means of a mounting ring. This ring encircles the movement and acts to effectively enlarge its diameter, the profile of the ring conforming to the inner contour of the case. Thus the mounting ring functions as an adapter for the standardized movement. By the use of appropriate adapters, it becomes possible to incorporate the same movement in a range of ladies' and gentlemen's watches having cases that differ both in their dimensions and shapes.

It is also known to provide otherwise identical battery-operated electronic watch movements with pillar plates of different size. In this way, at least in principle, identical watch movements which lend themselves to low-cost, mass production may be used in a more diversified manner with a broad range of differently-styled cases. Indeed, it then becomes possible, using the same machines and gauges, to produce a large series of movements which, despite their diversified end uses, differ from each other merely in the outer dimensions of their plates, the movements otherwise being the same.

With such families or sets of movements having different dimensioned plates but otherwise identical structures, the source of battery power is normally a flat, round, mercury or silver cell which is integrated with the movement. That is to say, the cell is either completely or partially surrounded by the electronic and mechanical components of the movement. Hence regardless of the dimensions or shapes of the plates, the dimensions of the power supply cells in all movements in the set are constant, for they are predetermined by the space allotted to the cell in the movement design. As a consequence, whether the standardized movement is incorporated in a large or small case, the battery is the same and its operating life is the same. Thus while a larger case has more space available for a battery of larger capacity, this space remains unexploited.

SUMMARY OF INVENTION

In view of the foregoing, the main object of this invention is to provide a family of electronic watch movements which are identical but for their plates which differ in size and, in some instances, also in shape to render the movements receivable in differently configured cases, the standardized movements in the family including batteries of different size which take advantage of the space made available by the plates to afford optimum battery life.

A significant advantage of a family of standardized watch movements in accordance with the invention is that it lends itself to low-cost mass production without the drawbacks arising with prior art families in which the same size battery is integrated in all movements regardless of the plate size. In the present invention, the bigger the plate in the standardized movement, the larger the battery cell associated therewith. In this way, when the plate is designed for a large size watch case, even though the components of the movement are the same as those used for a smaller-sized case, the region of the plate outside of the mounting zone for the components is used to accommodate a relatively large battery affording a prolonged operating life.

Briefly stated, the object of the invention is attained in a family of standardized movements which are receivable in watch cases of different dimensions, each movement in the family comprising a plate dimensioned to be received in a respective watch case and to conform to the interior contour thereof whereby the plates in the family differ in size.

Each plate in the family has a mounting zone provided with bores, millings and other elements for the placement and attachment of the watch components, the area of the region outside the mounting zone depending on the dimensions of the plate. A cut-out is formed in this region, which cut-out extends from the periphery of the plate to the edge of the mounting zone and is profiled to accommodate a circular battery cell whose diameter is substantially equal to the radial distance between the zone edge and the plate periphery.

The space for the battery cell defined by the cut-out depends, therefore, on the dimensions of the plate, whereby the larger the plate, the larger the cell and the greater its capacity and operating life.

OUTLINE OF DRAWINGS

For a better understanding of the invention as well as other objects and further features thereof, reference is made to the following detailed description to be read in conjunction with the accompanying drawings, wherein:

FIG. 1 schematically illustrates one watch movement in a family thereof in accordance with the invention;

FIG. 2 illustrates the second movement in the family;

FIG. 3 illustrates the third movement in the family; and

FIG. 4 illustrates the fourth movement in the family.

DESCRIPTION OF INVENTION

Referring now to the drawing, FIGS. 1 to 4 each illustrate a watch movement of the analog type; that is, a movement having time-indicating hands driven by an electronically-controlled motor. These four movements are members of a common family and constitute a set in which all movements are essentially of the same construction except for the diameter of the pillar plate. The mounting zone of the plate in each movement is provided with bores, pins, millings, and other elements adapted to facilitate the placement and attachment of the electronic and mechanical components of the movement. One embodiment of an electronic watch of the analog type is disclosed in the Mosimann et al. U.S. Pat. No. 4,117,663. It is to be understood, however, that the invention is applicable to all known forms of such electronic watches.

In FIG. 1, the movement includes a relatively small plate 1*a*, and in FIG. 2 plate 1*b* is of somewhat larger diameter. Plate 1*c* in FIG. 3 is of still larger diameter, while plate 1*d* in FIG. 4 has the largest diameter in the set. The particularly large movement shown in FIG. 4 is, for example, suitable for a gentleman's sport watch. Obviously, the set may be made up of more than four movements.

In the typical electronic watch of the analog type, the hour, minute and seconds hands are advanced by a stepping motor actuated by low-frequency pulses derived by a frequency divider from a high-frequency crystal-controlled time base or standard, the motor being coupled to the time-indicating hands through a gear train. In FIGS. 1 to 4, the movement illustrated therein includes an electronic module 2 which is provided with a quartz crystal 3 and an integrated circuit 4. Also included in the movement is a switch 5, which, when actuated, serves to shift the seconds hand of the watch in the manner, for example, disclosed in the above-identified Mosimann patent. The timing pulses generated by electronic module 2 are applied to a stepping motor 6 associated with a mechanical module 7 which carries the gear train driven by the motor. Also included is a power supply battery (10*a* to 10*d*) which is in the form of a circular cell.

The battery in each movement is seated within a concave cut-out 8 in the pillar plate, the diameter of the battery being such that it is almost equal to the radial distance between the edge of the cut-out which lies in the immediate vicinity of the center wheels of the gear train on the mechanical module 7 and the outer periphery of the plate.

The plates in the set are of progressively greater diameter, and the size of the batteries associated therewith are also of progressively greater diameter; the larger the battery, the greater is its capacity and the longer its operating life. Thus despite the fact that the watch movements in the set are all identical, it is possible in each movement to include a power source of the largest possible capacity; which is to say, a battery of the maximum size for the particular size of the plate.

Thus the movement in FIG. 1 includes a battery 10*a* of small diameter appropriate to the small diameter of plate 1*a*. The movement in FIG. 2 includes a battery 10*b* which is of larger diameter, for plate 16 in this movement has a diameter larger than that of plate 1*a*. In FIG. 3, the battery 10*c* therein is of still larger diameter, this being made possible by the larger diameter of plate 1*c*; and in FIG. 4, battery 10*d* is of the largest diameter in keeping with the large diameter of plate 1*d*.

To show the relationship between battery and plate size and to indicate the space occupied within the plate cut-out by the battery, in FIGS. 1, 2 and 3, the region within the cut-out which is not occupied by the battery is cross-hatched. The design is such that in the case of plate 1*d* in FIG. 4, battery 10*d* completely occupies the cut-out and there is no unoccupied region; whereas in FIG. 3, a small portion of the available space is not occupied. In the case of FIG. 2, a somewhat larger portion of the available cut-out space is unoccupied, there being still more unoccupied space in FIG. 1.

Thus in a family of electronic watch movements in accordance with the invention, all of the movements are identical in all respects, save for the dimensions of the plate on which the components are mounted, thereby making it feasible with the same movement to provide a power supply battery of the greatest possible capacity. In practical terms, this innovation is highly significant; for even though the movements are standardized, they can be used in conjunction with casings of different size and shape and with batteries whose sizes exploit whatever unused plate space is available.

Because plates 1*b*, 1*c* and 1*d* in FIGS. 2, 3, and 4 have more available space in the marginal region surrounding the mechanical and electronic components affixed thereto than plate 1*a* of FIG. 1 in the family of movements, the movements in FIGS. 2, 3 and 4 are further provided with a metal spring 12, one end of which is fastened to the plate. The free end of spring 12 carries a motion-transmission member 13. Member 13 serves to actuate switch 5 by means of a pushbotton 15 socketed in the case of the watch (not shown). Also shown in the figures is a setting crown 16.

While there has been shown and described a preferred embodiment of a standardized electronic watch movement in accordance with the invention, it will be appreciated that many changes and modifications may be made therein without, however, departing from the essential spirit thereof.

We claim:

1. A family of standardized movements for battery-operated electronic watches, which movements are receivable in watch cases having different configurations; each movement in the family comprising:

A. a pillar plate dimensioned to be received in a respective watch case and to conform to the interior contour thereof, whereby the plates in the family have different dimensions to conform to the different configurations of the watch cases; said electronic watch being of the analog type provided with mechanical components and electronic components;

B. said plate having a mounting zone to which is attached the components of the movement, the mounting zone and the components thereon being identical in all movements in the family, said plate mounting zone having millings, bores, and other elements for the placement and attachment of said components; said mechanical components including a stepping motor and a gear train, said gear train having center wheels;

C. the region on the plate outside the mounting zone having an area which depends on the dimensions of the plate, said region having a cut-out therein which extends from the edge of the mounting zone to the periphery of the plate and is profiled to accommodate a circular battery cell whose diameter is substantially equal to the radial distance between said zone edge and said plate periphery, the edge of said mounting zone to which said cut-out extends being directly adjacent said wheels, the space for the battery cell defined by the cut-out depending on the dimensions of the plate, whereby the bigger the plate, the larger the cell and the greater its capacity and operating life, said movement having an operating switch mounted on said plate which is actuated by a button socketed in the associated case; and D. a spring having one end anchored on said plate in said region, the free end of said spring having attached thereto a motion transmission element which is interposed between said button and said spring.

2. A family of movements as set forth in claim 1, wherein said cut-out has an arcuate profile to substantially conform to the periphery of said circular cell.

* * * * *